US006182749B1

(12) United States Patent
Brost et al.

(10) Patent No.: US 6,182,749 B1
(45) Date of Patent: Feb. 6, 2001

(54) HEAT EXCHANGER SYSTEM WITH INTEGRAL CONTROL VALVE

(75) Inventors: Viktor Brost, Aichtal; Klaus Kalbacher, Rangendingen, both of (DE)

(73) Assignee: Modine Manufacturing Company, Racine, WI (US)

( * ) Notice: Under 35 U.S.C. 154(b), the term of this patent shall be extended for 0 days.

(21) Appl. No.: 09/193,483

(22) Filed: Nov. 17, 1998

(30) Foreign Application Priority Data

Nov. 17, 1997 (DE) ..... 197 50 814

(51) Int. Cl.[7] ..... F28F 27/02; F28F 3/08; F28F 3/10

(52) U.S. Cl. ..... 165/297; 165/167; 165/916; 165/103; 123/196 AB

(58) Field of Search ..... 165/916, 167, 165/103, 297, 298, 299, 274; 123/196 AB, 557

(56) References Cited

U.S. PATENT DOCUMENTS

| | | | | |
|---|---|---|---|---|
| 1,382,569 | * | 6/1921 | Tait | 165/298 |
| 2,070,092 | * | 2/1937 | Ramsaun | 165/916 |
| 2,213,017 | * | 8/1940 | Perkins | 165/299 |
| 2,655,351 | * | 10/1953 | Hytte | 165/167 |
| 2,776,092 | * | 1/1957 | Collins, Jr. | 165/274 |
| 3,343,536 | * | 9/1967 | Brisson et al. | 165/166 |
| 3,513,907 | * | 5/1970 | Hughes | 165/299 |
| 3,743,011 | * | 7/1973 | Frost | 165/167 |
| 4,595,046 | * | 6/1986 | Iino | 165/299 |
| 4,669,532 | | 6/1987 | Tejima et al. | 165/119 |
| 5,810,071 | | 9/1998 | Pavlin | 165/284 |
| 5,950,715 | * | 9/1999 | Jonsson et al. | 165/167 |
| 5,960,872 | * | 10/1999 | Huemer et al. | 165/299 |

FOREIGN PATENT DOCUMENTS

| | | | | |
|---|---|---|---|---|
| 751785 | * | 2/1953 | (DE) | 123/196 AB |
| 3637483 | * | 1/1988 | (DE) | 123/557 |
| 19637818 | | 4/1998 | (DE) . | |
| 787929 | | 8/1997 | (EP) . | |
| 0285649 | * | 11/1989 | (JP) | 123/557 |
| WO/94/14021 | * | 6/1994 | (WO) | 165/167 |
| 94/29659 | | 12/1994 | (WO) . | |

* cited by examiner

*Primary Examiner*—John K. Ford
(74) *Attorney, Agent, or Firm*—Wood, Phillips, VanSanten, Clark & Mortimer

(57) ABSTRACT

A heat exchanger system is provided having a heat exchanger including a plurality of conduits to receive a first fluid. The conduits have a plurality of passages therebetween which are in heat exchange relation therewith to receive a second fluid. An inlet and an outlet are connected to the plurality of conduits, and an inlet and outlet are connected to the plurality of passages. A valve is connected to one of the inlets to limit fluid flow therethrough. A thermally-responsive actuator is provided for the valve and extends into one of the conduits and the passages to control the valve as an incident of the temperature of a fluid flowing through the one of the conduits and the passages.

10 Claims, 6 Drawing Sheets

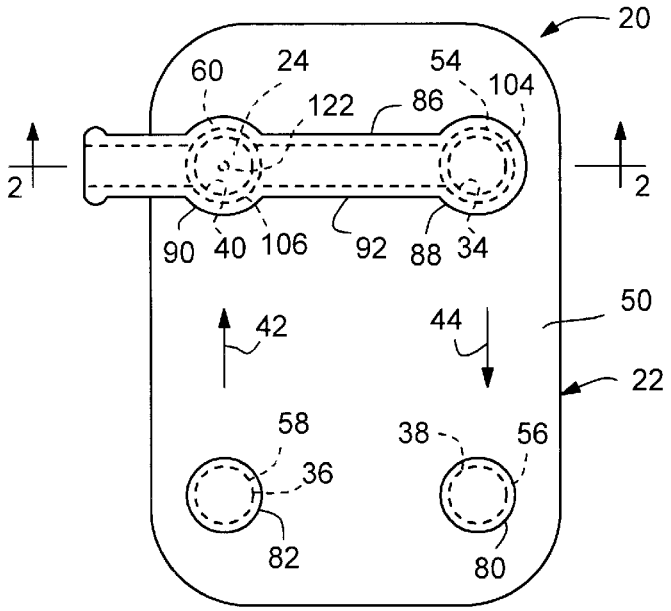
FIG. 1
FIG. 2
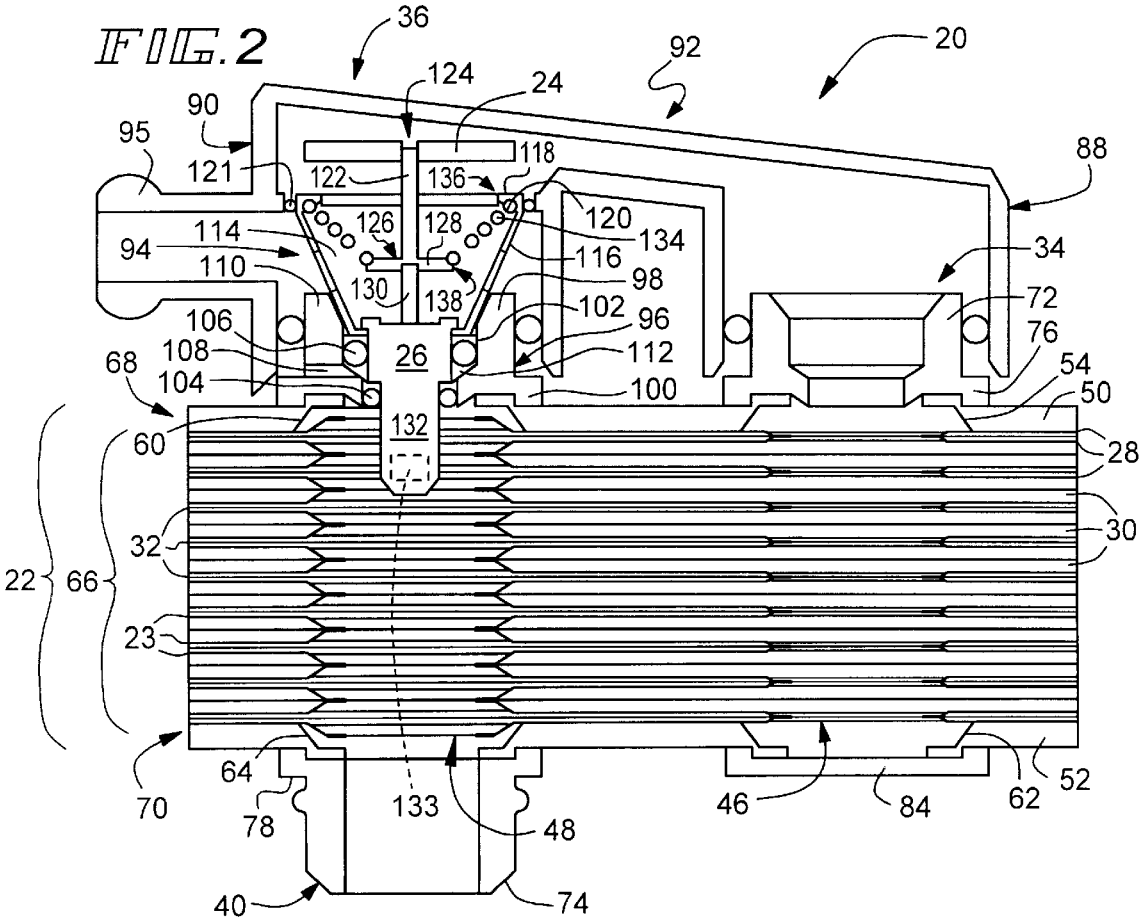

HEAT EXCHANGER SYSTEM WITH INTEGRAL CONTROL VALVE

FIELD OF THE INVENTION

The present invention is directed to a heat exchanger system which is responsive to changes in the temperature of a fluid flowing through the heat exchanger system, and in particular to changes in the temperature of a fluid as it flows through a heat exchanger in the heat exchanger system.

BACKGROUND OF THE INVENTION

Heat exchanger systems which vary the path of fluid flowing therethrough in response to a change in the characteristics (e.g. temperature, pressure, etc.) of the fluid are old in the art. For example, WO 94/29659 shows a plate-type oil cooler which has a pressure-responsive valve assembly connected to the inlet of the oil-side to permit the oil to bypass the oil-side of the cooler when the pressure on the oil-side of the cooler exceeds a predetermined value. Alternatively, U.S. Pat. No. 4,669,532 discloses a bimetallic valve which is disposed in the oil-side of an oil cooler to permit the oil to bypass the oil-side of the cooler when the temperature of the oil is below a predetermined value.

Additionally, there are numerous examples of heat exchanger systems wherein the flow rate of a fluid flowing through a heat exchanger is controlled according to the temperature of that of another fluid flowing through the heat exchanger. For example, German Laid-Open Application No. 196 37 818 and European Laid-Open Application No. 787 929 show two such systems wherein the flow of coolant through an oil cooler is controlled in response to the temperature of the oil flowing through the heat exchanger. In both of the systems, a thermostat is located upstream of the inlet to measure the oil temperature before the oil enters the heat exchanger, although it is also known to control the flow of coolant through the heat exchanger system in response to the oil temperature as it exits the heat exchanger.

The problem with these systems is that they may take up considerable amounts of space, which is always at a premium in automotive applications, a primary use of this art. Additionally, these systems may add weight to the vehicle to which they are attached, possibly degrading fuel economy thereby. Furthermore, the environment surrounding the thermostat in these systems may affect the oil temperature reading, causing more or less coolant to be directed to the heat exchanger than is actually necessary.

SUMMARY OF THE INVENTION

According to an aspect of the present invention, a heat exchanger system has a heat exchanger including a plurality of conduits to receive a first fluid. The conduits have a plurality of passages therebetween which are in heat exchange relation therewith to receive a second fluid. An inlet and an outlet are connected to the plurality of conduits, and an inlet and outlet are connected to the plurality of passages. A valve is connected to one of the inlets to limit fluid flow therethrough. A thermally-responsive actuator is provided for the valve and extends into one of the conduits and the passages to control the valve as an incident of the temperature of a fluid flowing through the one of the conduits and the passages.

In a preferred embodiment, the thermally-responsive actuator may extend into one of the conduits and the passages between the respective inlet and outlet.

In another preferred embodiment, an entry conduit may be connected to the one of the inlets, said valve being disposed in the entry conduit to limit fluid flow therethrough to the one of the inlets.

Moreover, a bypass conduit may be connected to the entry conduit, the bypass conduit having an inlet connected to the entry conduit upstream of the valve and an outlet connected to the entry conduit downstream of the valve.

Furthermore, a bypass valve may be associated with the bypass conduit to limit the fluid flow therethrough. The bypass valve may be seatable in the outlet of the bypass conduit. Further, the bypass valve may be a bimetallic strip with a first end attached to the entry conduit and a second end disposed to occlude the bypass conduit outlet to limit the fluid flow therethrough. A thermally-responsive actuator may be included for the bypass valve, the actuator extending into the bypass conduit to control the bypass valve as an incident of the temperature of a fluid flowing through the bypass conduit.

According to another aspect of the present invention, a plate type heat exchanger system includes a heat exchanger with a plurality of spaced plates secured together to form a stack having a plurality of fluid flow channels extending between adjacent plates, the channels of the plurality being divided into at least two groups, and an inlet and an outlet connected to the channels of each group. The system also includes an entry conduit attached to one of the inlets, a valve disposed within the entry conduit to limit the fluid flow through the conduit to said one of the inlets, and a thermally-responsive actuator for the valve and extending into one of the groups of channels between the respective inlet and outlet to control the valve as an incident of the temperature of a fluid flowing through the one of the groups of channels into which the thermally-responsive actuator extends.

In a preferred embodiment of the system, the system may include a bypass conduit connected to the entry conduit, the bypass conduit having an inlet connected to the entry conduit upstream of the valve and an outlet connected to the entry conduit downstream of the valve.

Moreover, a bypass valve may be associated with the bypass conduit to limit the fluid flow therethrough. The bypass valve is seatable in the outlet of the bypass conduit. Additionally, the bypass valve may be a bimetallic strip with a first end attached to the entry conduit and a second end disposed to occlude the bypass conduit outlet to limit the fluid flow therethrough. The system may include a thermally-responsive actuator for the bypass valve extending into the bypass conduit to control the bypass valve as an incident of the temperature of a fluid flowing through the bypass conduit.

In another preferred embodiment of the system, the heat exchanger may include a cover plate and a base plate, the stack of plates being disposed between the cover plate and the base plate such that one of the plurality of plates abuts the cover plate and another of the plurality of plates abuts the base plate. The inlets and outlets may be attached to the base plates to connect the inlets and outlets with the respective channel groups.

In still another preferred embodiment of the system, the heat exchanger may include a housing with a wall defining a cavity therein, and the stack of plates may be disposed within the cavity such that the cavity is in fluid communication with one of the channel groups and that fluid communication between the cavity and the other channel group is limited.

BRIEF DESCRIPTION OF THE DRAWINGS

FIG. 1 is a plan view of a heat exchanger system according to the present invention wherein the flow of a first fluid is controlled in response to the temperature of a second fluid;

FIG. 2 is a cross-sectional view of the heat exchanger system of FIG. 1 taken about line 2—2, with a valve in an open position;

DETAILED DESCRIPTION OF THE PREFERRED EMBODIMENT

Figure 3:
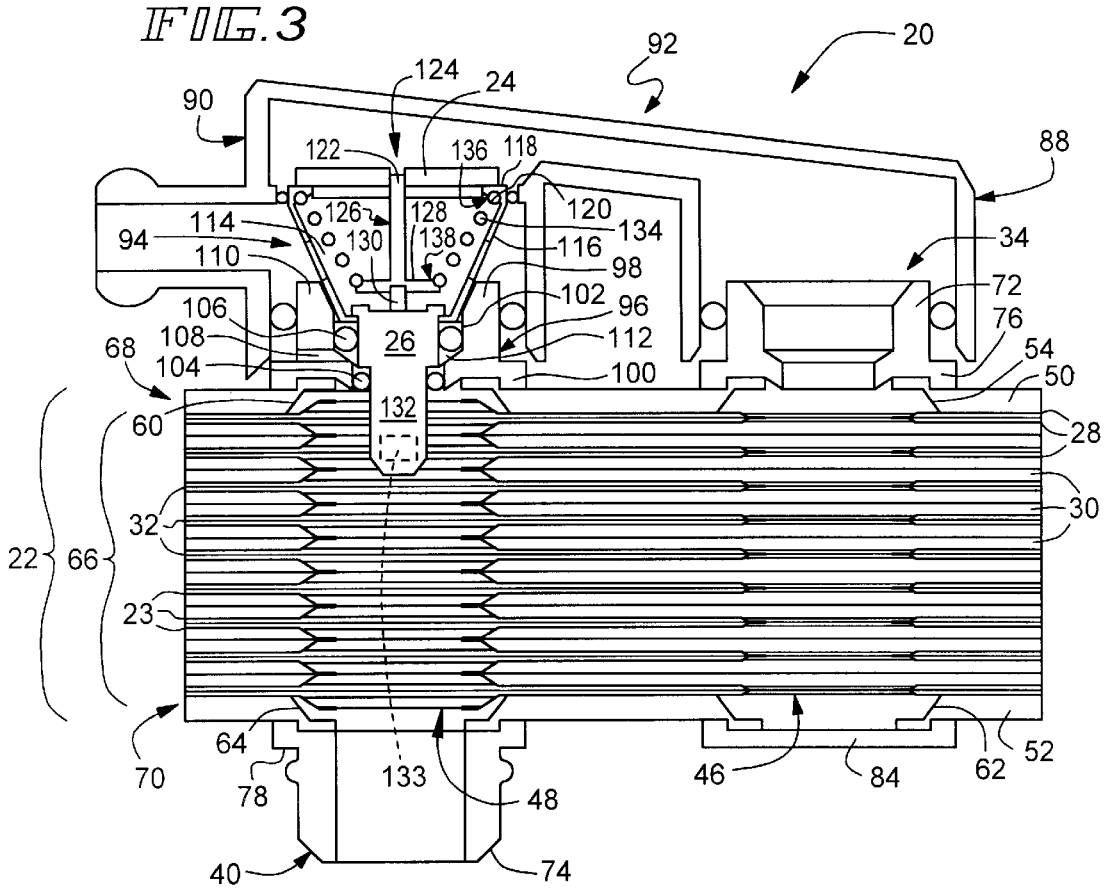
FIG. 3 is a cross-sectional view of the heat exchanger system of FIG. 2, with a valve in a closed position.

FIGS. 1–3 illustrate an embodiment of the present invention for a heat exchanger system 20. As best seen in FIGS. 2 and 3, the heat exchanger system 20 includes a heat exchanger 22, a valve 24 and a thermally-responsive actuator 26 which may be of conventional construction.

Specifically, as seen in FIGS. 2 and 3, the heat exchanger 22, for example an oil cooler associated with an internal combustion engine, is made of a plurality of spaced plates 28 which define two groups, each of a plurality of conduits, channels or passages 30, 32 therebetween. The channels 30 of the first group are disposed between the channels 32 of the second group and in heat exchange relationship therewith. Where the heat exchanger 22 is, for example, an oil cooler, the coolant may flow through the channels 30, while the oil may flow through the channels 32. As shown in FIGS. 1–3, each group of channels 30, 32 has an inlet 34, 36 and an outlet 38, 40, with the inlet 34 and the outlet 38 connected to the first group of channels 30, and the inlet 36 and the outlet 40 connected to the second group of channels 32.

The valve 24 is connected to the inlet 34 of the first group of channels 30 so that the valve 24 may be moved between open (FIG. 2) and closed (FIG. 3) positions to limit the flow of a fluid through the first group of channels 30. In particular, the valve 24 is connected to the thermally-responsive actuator 26, which extends into the second group of channels 32. The actuator 26 moves the valve 24 between the open (FIG. 2) and closed (FIG. 3) positions in response to the temperature of the fluid (e.g. oil) flowing in the second group of channels 32.

In operation, when the internal combustion engine associated with the oil cooler/heat exchanger 22 is started, the oil flowing between the inlet 36 and the outlet 40 in the second group of channels 32 (as indicated by an arrow 42) is at a first temperature. At this first temperature, it may not be necessary to cool the oil, and, in fact, it may even be desirable to heat the oil. The temperature of the oil is sensed by the thermally-responsive actuator 26, which does not move the valve 24 into the open position (FIG. 2) if the temperature is below a predetermined level. Instead, the valve 24 remains in its closed position (FIG. 3), and the oil may thus heat quickly to its operating temperature.

Over time, the heat from the engine will be transferred to the oil, and the temperature of the oil will rise. The change in temperature is sensed by the thermally-responsive actuator 26. When the temperature of the oil exceeds the aforementioned predetermined value, the actuator 26 causes the valve 24 to begin to move from the closed position (FIG. 3) toward the open position (FIG. 2) so that coolant flows into the inlet 34 and through the first group of channels 30 (as indicated by an arrow 44) as oil flows through the second group of channels 32. As the oil temperature continues to rise, the valve will ultimately move to the full open position shown in FIG. 2. Heat is transferred between the first and second groups of channels 30, 32, and between the coolant and oil flowing therethrough. As a further consequence, the oil is cooled through the transfer of heat to the coolant.

The heat exchanger system 20 is now discussed in greater detail, again with reference to FIGS. 1–3. As mentioned above, the heat exchanger 22 is a plate-type heat exchanger, and more particularly a housingless plate-type heat exchanger, made up of plates 28 which may be joined together, by soldering or brazing for example, and which define channels 30, 32 therebetween. Each plate 28 has four openings therethrough, two openings in fluid communication with the first group of channels 30 (one of which, an opening 46, is shown in FIGS. 2 and 3) and two openings in fluid communication with the second group of channels 32 (one of which, an opening 48, is shown in FIGS. 2 and 3). The heat exchanger 22 also includes a cover plate 50 and a base plate 52, which have corresponding openings. All four openings 54, 56, 58, 60 in the cover plate 50 are shown in FIG. 1, while two of the four openings 62, 64 are shown in the base plate 52 in FIGS. 2 and 3.

As assembled, the individual plates 28 are attached to each other to form a stack 66 with the openings in each plate 28 aligned with the opening in the other plates 28. The cover plate 50 is attached to one of the plates 28 at a first end 68 of the stack 66, with the openings in the plates 28 aligned with the openings in the cover plate 50. Similarly, the base plate 52 is attached to one of the plates 28 at a second end 70 of the stack 66, with the openings in the plates 28 aligned with the openings in the base plate 52.

The inlets 34, 36 and outlets 38, 40 are attached to the cover plate 50 and the base plate 52 so as to be aligned with one of the openings mentioned previously. As shown in FIGS. 2 and 3, the inlets (specifically the inlet 34) and the outlets (specifically 40) include a first cylindrical section 72, 74 which is attachable to a tube or hose, and a second cylindrical section 76, 78 which is joined to the cover and base plates 50, 52, respectively. To cover those openings in the cover and base plates 50, 52 which are not connected to one of the inlets 34, 36 or outlets 38, 40, caps are provided (of which caps 80, 82 are shown in FIG. 1 and a cap 84 is shown in FIGS. 2 and 3) to prevent leakage of the respective fluid (in this case, coolant or oil) from the heat exchanger 22.

A generally U-shaped entry conduit 86 is provided, having a first leg 88, a second leg 90 and a bight 92. The first leg 88 is connected to the inlet 34, while the second leg 90 is connected to a valve assembly 94, which includes the valve 24 and thermally-responsive actuator 26, and which is disposed in the opening 60 in the cover plate 50 into the second group of channels 32 immediately opposite the outlet 40. Alternatively, the entry conduit 86 could have a leg (not shown) for connection to the coolant outlet 38 in addition to the leg 88 connected to the inlet 34, separated by a wall therebetween. A connection tube 95 is also attached to the second leg 90 of the entry conduit 86 to provide a site for attachment of a tube or hose. O-rings are disposed between the inlet 34, the valve assembly 94, and the first and second legs 88, 90 of the entry conduit 86 to limit the leakage of coolant from the entry conduit 86.

In addition to the valve 24 and the thermally-responsive actuator 26, the valve assembly 94 includes a housing 96 which has first and second cylindrical sections 98, 100 with a stepped bore 102 therethrough. The actuator 26 is disposed in the bore 102 with spaced first and second O-rings 104, 106 disposed between the actuator 26 and the housing 96. The O-ring 104 limits leakage of coolant from the entry conduit 86, while the O-ring 106 limits leakage of oil from the heat exchanger 22. A cross-bore 108 is provided through a wall 110 of the first cylindrical section 98 between the first and second O-rings 104, 106 to exhaust a space 112 between the first and second O-rings 104, 106 to the environment through a small gap between the entry conduit 86 and the housing 96. By allowing any leakage to exhaust from the heat exchanger 22, the leak may be recognized before mixing of the oil and the coolant occurs.

The valve assembly 94 also includes a frusto-conically-shaped cage 114 attached (for example, by a threaded attachment) to the housing 96 and having a perforated wall 116. Alternatively, a mesh wall could be used. As a further alternative, the cage 114 need not be formed by a single wall, but may be defined by more than one wall, for example by two walls, as suggested in German Laid Open Application No. 197 50 814.6, incorporated in its entirety by reference herein. An upper rim 118 of the cage 114 defines a valve seat on which the valve 24 rests in the closed position (FIG. 3). The rim 118 is turned back on itself to form a channel 120, and is sealed to the entry conduit 86 by an O-ring 121.

The valve assembly 94 further includes a connection rod 122 which is attached at a first end 124 to the valve 24 and at a second end 126 to a stop 128. The stop 128 is also connected to an actuator rod 130 which is part of the thermally-responsive actuator 26 (for example, a thermostat such as a Wechs thermostat), and which moves relative to an actuator housing 132 in response to the temperature sensed by a thermal sensor 133 housed within the actuator housing 132 and extending into the channels 32. According to one embodiment of the present invention, the actuator rod 130 is continuously moveable relative to the housing 132, for example as a consequence of the expansion of material within the thermally-responsive actuator 26 as a result of heating. According to another embodiment (not shown), the actuator 26 may have an electric heater included therewith to adjust coolant flow in a predictive fashion to prevent temperature spikes from forming (see German Laid-Open Application No. 197 50 814.6, previously incorporated by reference, and European Laid-Open Application No. 787 929), in which case the line for the heater may be passed through the cross-bore 108.

A spring 134 is disposed between the cage 114 and the stop 128 to resist movement of the valve 24 from the rim 118 of the cage 114. Specifically, a first end 136 is received in the channel 120 formed by the rim 118, which a second end 138 is attached to the stop 128. While any type of biasing mechanism or spring may be used, a compression spring is shown in FIGS. 2 and 3.

As explained above in more general terms, during operation of the heat exchange system 20, the thermally-responsive actuator 26, which extends into the second group of channels 32, controls the movement of the valve 24 to limit the flow of the coolant through the first group of channels 30 in response to the temperature of the oil in the second group of channels 32. As further noted above, the response of the thermally-responsive actuator 26 is continuous in response to changes in the temperature of the oil in the second group of channels 32. Therefore, as the temperature of the oil changes as heat is exhausted into the oil stream during the operation of the engine with which the heat exchanger system 20 is associated, the actuator allows for proportional response to the cooling needs of the oil stream; i.e. more coolant is allowed to flow as the oil temperature rises, and less coolant is allowed to flow as the oil temperature falls.

By extending the actuator 26 into the heat exchanger 22, rather than mounting actuator 26 before the inlet 36 or after the outlet 40 of the oil stream, environmental influences on the measurement of the oil temperature may be minimized, making the temperature measurement more representative of the actual coolant flow necessary to remove the exhaust heat in the oil stream. Additionally, by packaging the valve 24 and actuator 26 within the heat exchanger 22, the size and weight of the system 20 may be reduced. As a further consequence of the configuration of the system 20, the number of connections required to install the system 20 relative to prior art systems may be greatly reduced, making installation simpler and cheaper.

Figure 4:
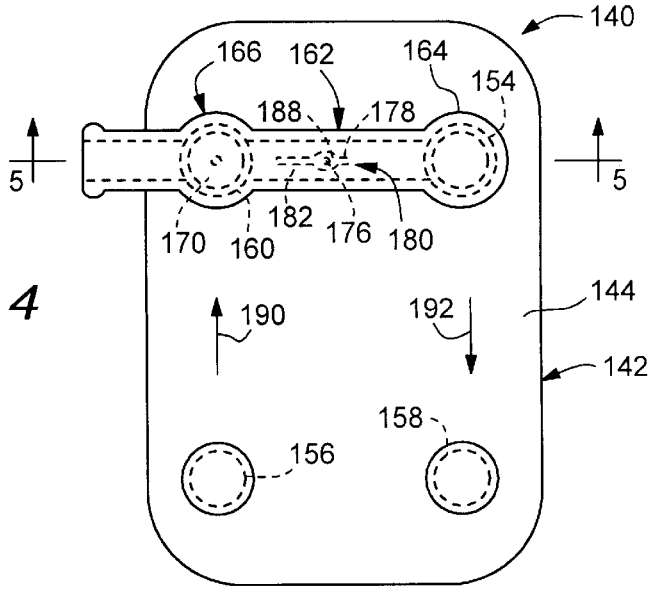
FIG. 4 is a plan view of another heat exchanger system according to the present invention with a bypass conduit and a bypass valve to control the flow of fluid through the bypass conduit.
Figure 5:
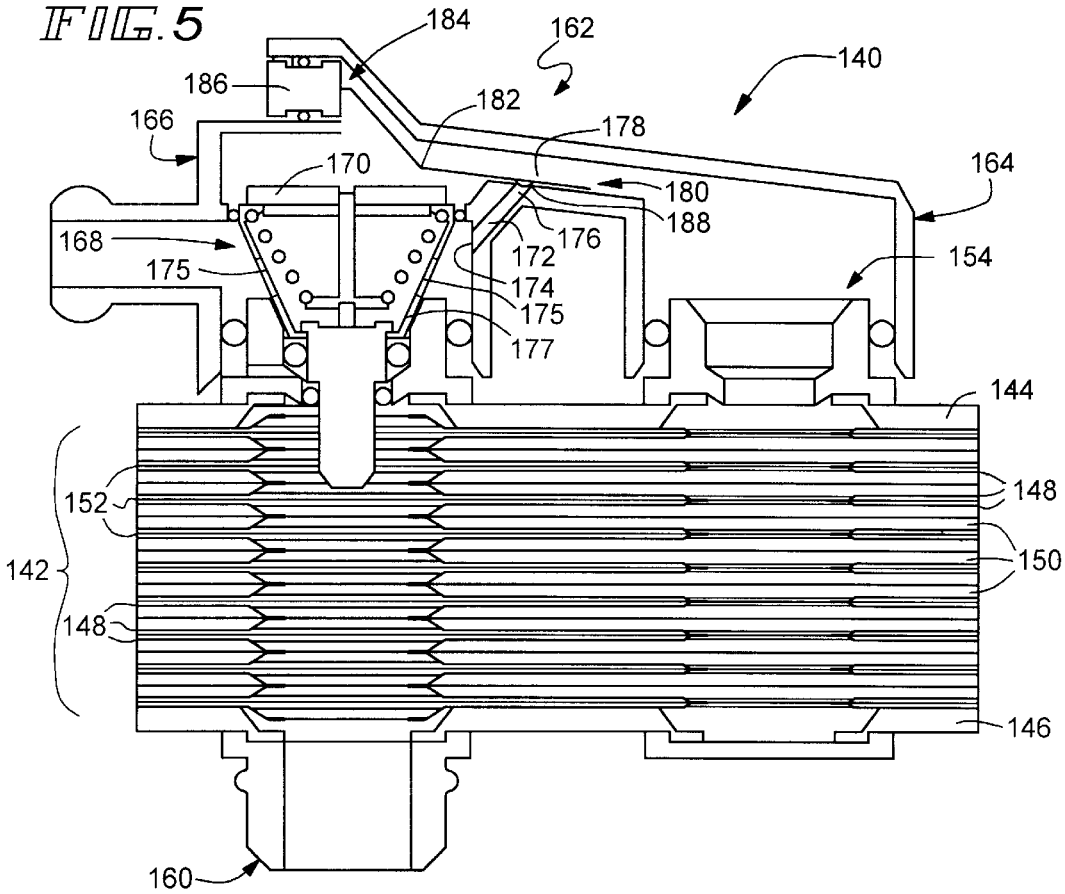
FIG. 5 is a cross-sectional view of the heat exchanger system of FIG. 4 taken about line 5—5.

Another embodiment of a heat exchanger system 140 according to the present invention is shown in FIGS. 4 and 5. The heat exchanger system 140 shares substantially the same structure as the heat exchanger system 20, and therefore only the differences between the two systems 20, 140 will be discussed.

The heat exchanger system 140 includes a housingless, plate-type heat exchanger 142 (see FIG. 5) having a cover plate 144, a base plate 146, and a plurality of individual, channel-defining plates 148. The plates 148 define at least two groups of channels 150, 152 for a first and a second fluid, for example coolant and oil. Inlets 154, 156 and outlets 158, 160 are connected to the first and second groups of channels 150, 152. A U-shaped entry conduit 162 having first and second legs 164, 166 is attached to the inlet 154 and a valve assembly 168, including a valve 170.

Unlike the entry conduit 86, the entry conduit 162 has a bypass conduit 172 connected thereto. Specifically, the bypass conduit 172 has an inlet 174 connected to the entry conduit 162 at a point upstream of the valve 170. The bypass conduit 172 also has an outlet 176 connected to the entry conduit 162 at a point downstream of the valve 170. Thus, coolant may bypass the valve 170, providing a continuous stream of coolant through the heat exchanger 142. To accommodate the flow of coolant passing through the entry conduit 162 to the bypass, openings 175 are provided in a cage 177.

The heat exchanger system 140 also includes a bypass valve 178. The bypass valve 178 is provided to limit the flow of coolant through the bypass conduit 172. The bypass valve 178 is defined by a first end 180 of a strip 182 of bimetallic material which is fixedly attached at a second end 184 to a holder 186 secured to the entry conduit 162. The outlet 176 of the bypass conduit 172 defines a valve seat 188 on which the valve 178 is seated when in the closed position, as is shown in FIG. 5. By making the valve 178 out of a bimetallic material, a narrower range of temperature limits may be achieved.

The bypass conduit 172 is provided to allow already heated coolant to flow through the heat exchanger 142 to accelerate the heating of the oil flowing through the heat exchanger 142. The bypass valve 170 is provided to substantially limit the flow of coolant into the heat exchanger 142 once a predetermined coolant temperature is reached, thereby limiting the preheating of the oil flowing through the heat exchanger 142. For example, the valve 178 may be fully closed or seated when the valve 170 is fully open or unseated. Alternatively, the bypass valve 178 may prevent the coolant from entering the heat exchanger 142 except when the oil is very cold.

Figure 6:
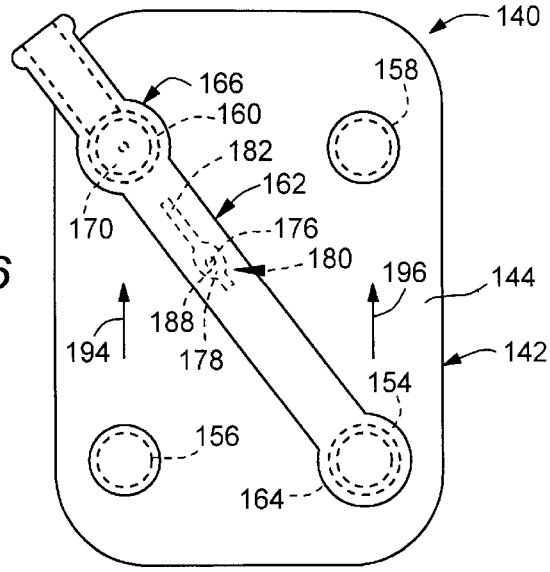
FIG. 6 is a plan view of an alternative configuration of a heat exchanger system according to the present invention with a bypass conduit and bypass valve.

In the embodiment of the present invention shown in FIGS. 4 and 5, the flow of the oil and the coolant is shown by arrows 190, 192. As shown, the oil and coolant flow in opposite directions, or in countercurrent flow, as also shown in FIG. 1. It is not necessary for the oil and coolant to flow in opposite directions, and as shown in FIG. 6, the heat exchanger system 140 may be reconfigured so that the oil and coolant flow in the same direction, as shown by arrows 194, 196.

Figure 7:
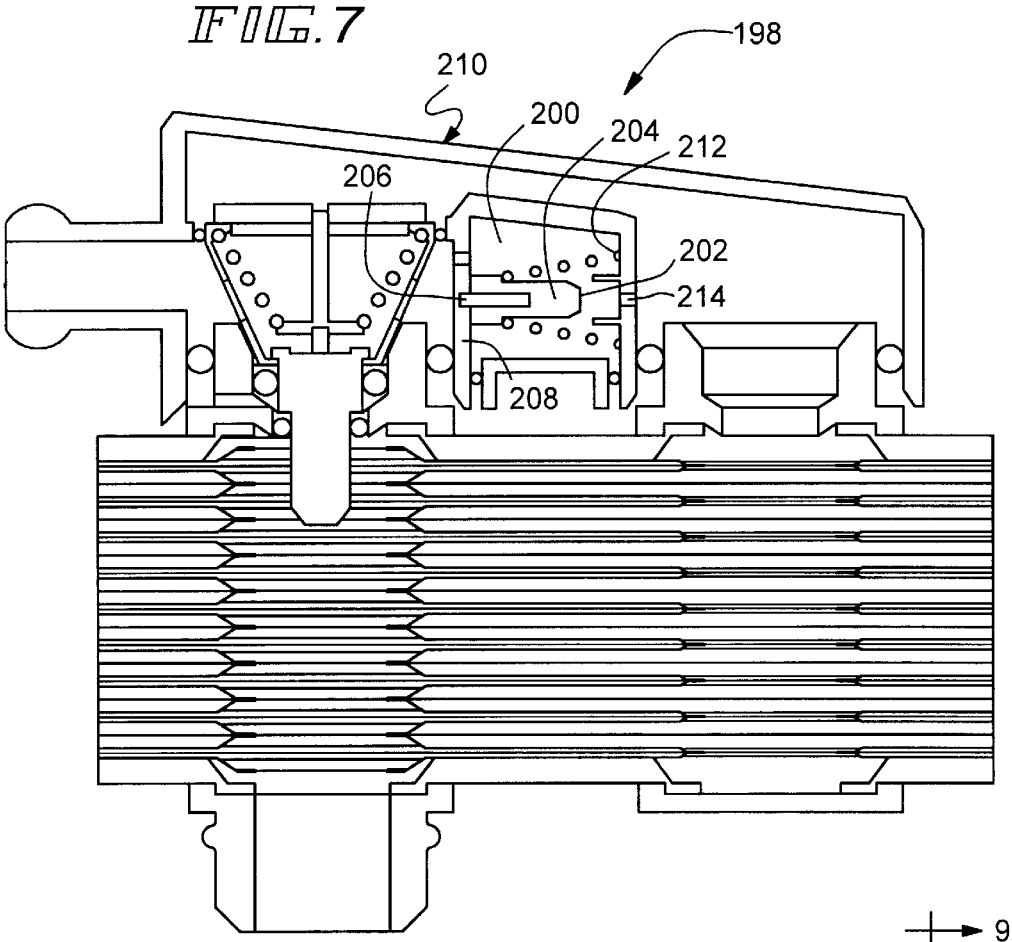
FIG. 7 is a cross-sectional view of a further heat exchanger system according to the present invention similar to that shown in FIGS. 4 and 5, but with an alternative bypass conduit and bypass valve.

Moreover, alternative bypass conduits and bypass valves may be used while remaining within the spirit of the present invention. For example, FIG. 7 shows a heat exchanger system 198 substantially similar to the heat exchanger system 140. A bypass conduit 200 and a bypass valve 202 are provided and have a structure different from those shown in FIG. 5.

For example, the bypass valve 202 is disposed entirely within the bypass conduit 200 in the heat exchanger system 198 shown in FIG. 7. Additionally, the bypass valve 202 is defined by a surface of a thermally-responsive actuator 204, and is moved by an actuator rod 206 supported against a wall 208 of an entry conduit 210 against the force of a spring 212 which maintains the bypass valve 202 in an normally open position. However, similar to the bypass valve 170, the bypass valve 202 is seated on a valve seat defined by an outlet 214 of the bypass conduit 200 in the closed position.

Figure 8:
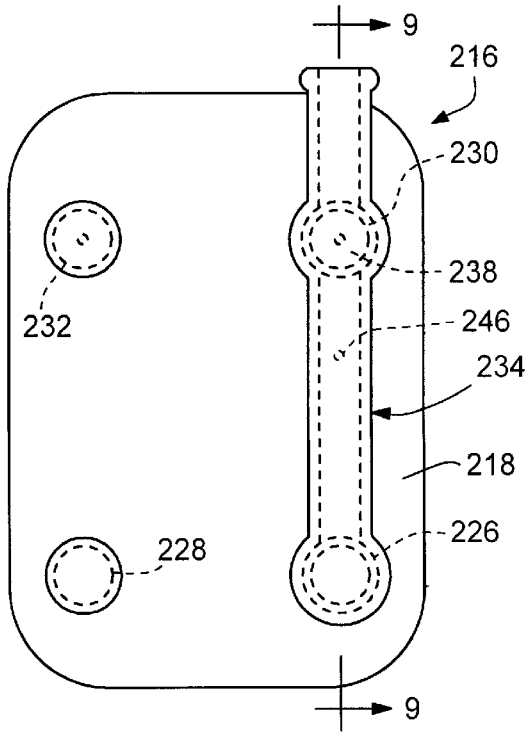
FIG. 8 is a plan view of a still further heat exchanger system according to the present invention wherein the flow of a first fluid through the system is controlled in response to the temperature of the first fluid.
Figure 9:
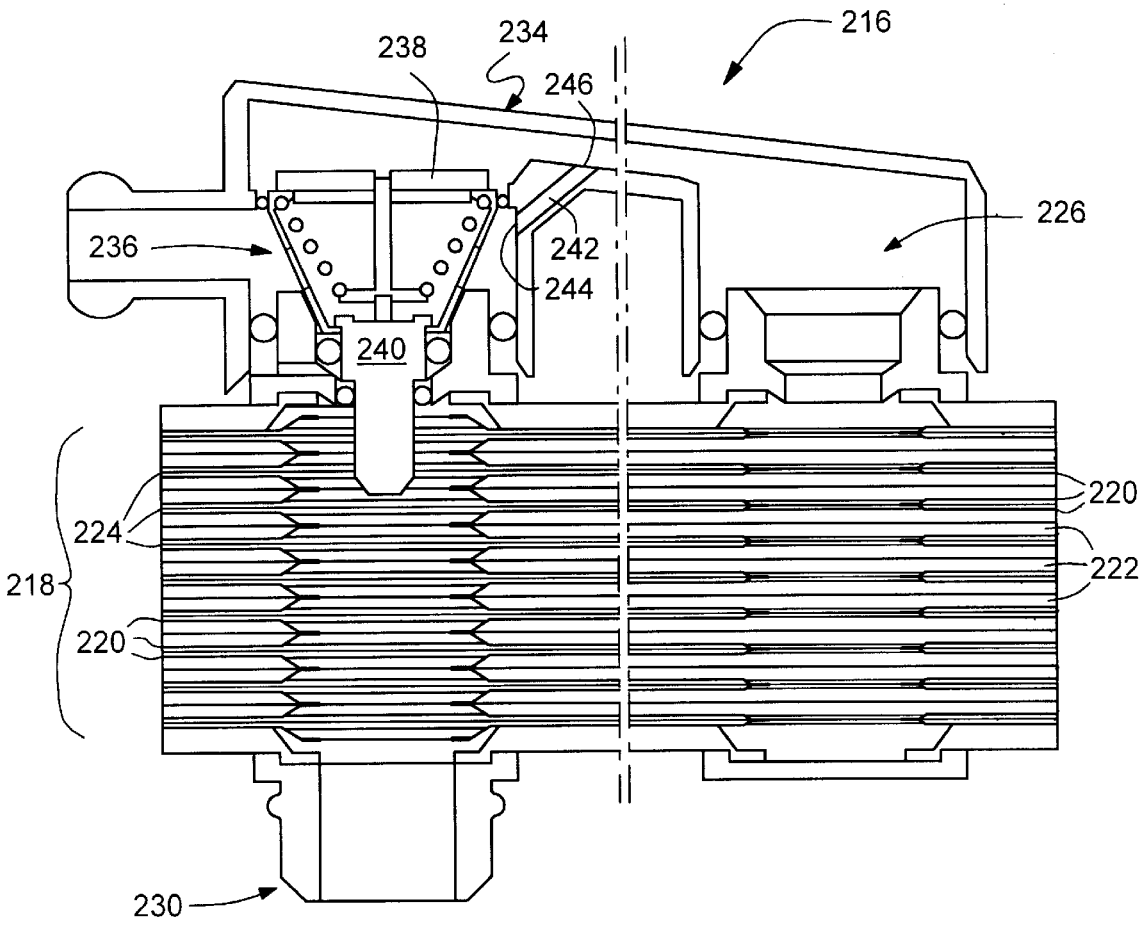
FIG. 9 is a cross-sectional view of the heat exchanger system of FIG. 8 taken about line 9—9.

A further alternative heat exchanger system 216 is shown in FIGS. 8 and 9. Unlike the heat exchanger systems 20, 140 and 198, the heat exchanger system 216 controls the flow of the coolant in response to the temperature of the coolant.

Specifically, the heat exchanger system 216 includes a heat exchanger 218 made of plates 220 which define first and second groups of channels 222, 224. Inlets 226, 228 and outlets 230, 232 are connected to the first and second groups of channels 222, 224, with the inlet 226 and the outlet 230 connected to the first group of channels 222 and the inlet 228 and the outlet 232 connected to the second group of channels 224.

An entry conduit 234 is connected to the inlet 226 and a valve assembly 236, including a valve 238 and a thermally-responsive actuator 240. The thermally-responsive actuator 240 extends into the first group of channels 222, and thus responds to changes in the temperature of the fluid (in this case, coolant) which flows through the first group of channels 222. As the control of the coolant flow is based on the temperature of the coolant flowing through the heat exchanger 218, a permanently open bypass conduit 242 is included with an inlet 244 connected upstream of the valve 238 and an outlet 246 connected downstream of the valve 238. The open bypass conduit 242 ensures a stream of coolant is continuously supplied to the heat exchanger 216 to flow past the thermally-responsive actuator 240.

It should be noted that as coolant is flowing on both sides of the actuator 240, the double O-ring seal formed in the other heat exchange systems 20, 140, 198 is not necessary because the concern for mixing of fluid from one side of the actuator 240 with fluid from the other side of the actuator 240 does not exist in this embodiment.

Figure 10:
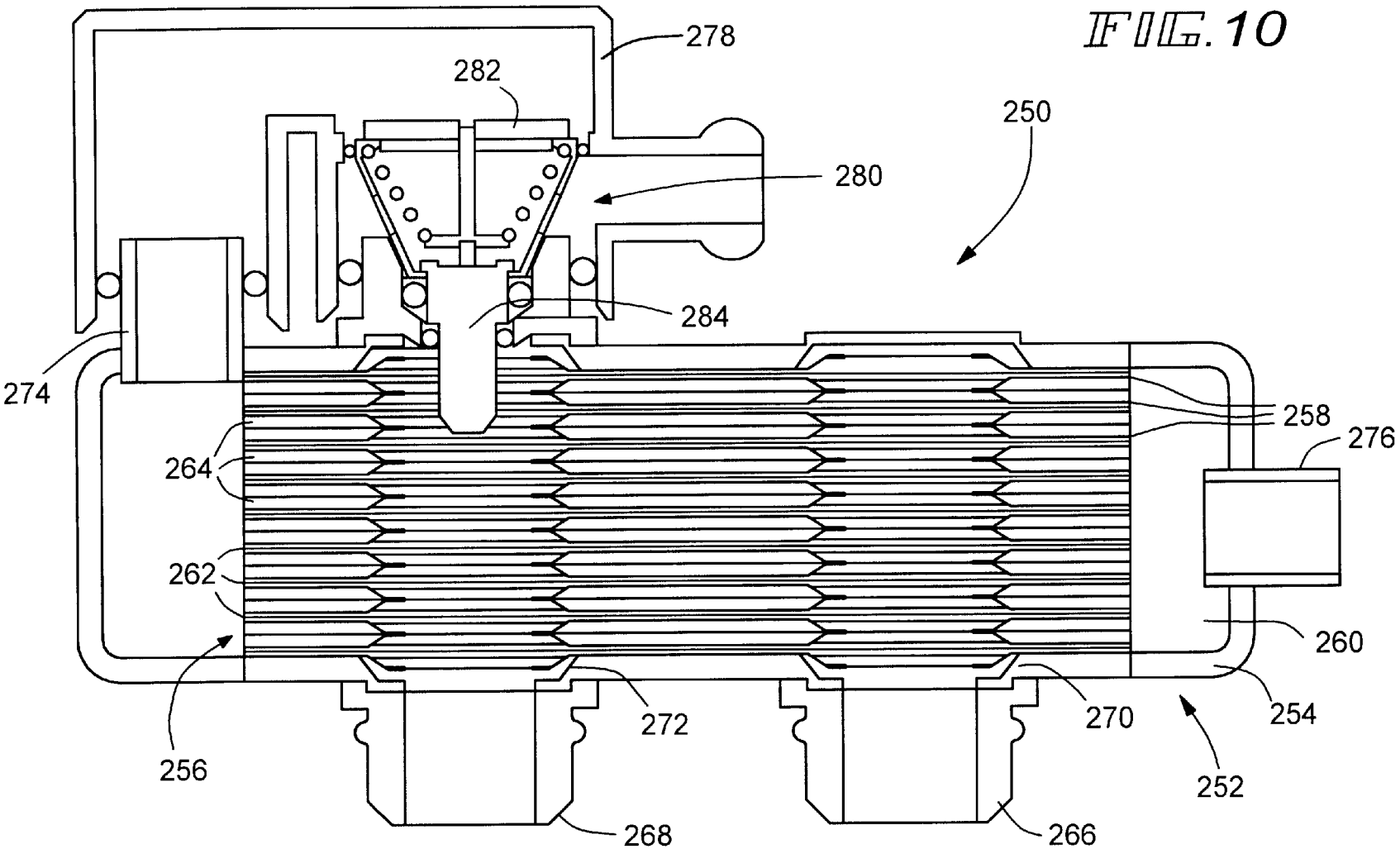
FIG. 10 is a cross-sectional view of yet another heat exchanger system according to the present invention, wherein a plate-type heat exchanger with housing is shown.

FIG. 10 shows still another alternative heat exchanger system 250 according to the present invention. The heat exchanger system 250 is structurally different from the heat exchanger systems 20, 140, 198, 216 described above in that a plate-type heat exchanger 252 having a housing 254 is used. Operationally, the heat exchanger system 250 functions similarly to the systems 20, 140, 198, 216.

The system 250 includes a stack 256 of plates 258 which is disposed in a cavity 260 defined by the housing 254. The plates 258 which define a first plurality of channels 262 and a second plurality of channels 264. The channels 262 are connected to an inlet 266 and an outlet 268 disposed through openings 270, 272 in the housing 254. By contrast, the channels 264 are connected to an inlet 274 and an outlet 276 in fluid communication with the cavity 260 in which the stack 256 of plates 258 is disposed.

Connected to the inlet 274 is an entry conduit 278 in which a valve assembly 280, including a valve 282 and a thermally-responsive actuator 284. The thermally-responsive actuator 284 extends into the channels 262, through which a fluid, for example oil, is flowing. In response to the temperature of the oil flowing in the channels 262, the actuator 284 moves the valve 282 to control the amount of a second fluid, coolant for example, that enters the cavity 260 and flows through the channels 264.

Still other aspects, objects and advantages of the present invention can be obtained from a study of the specification, the drawings, and the appended claims.

We claim:

1. A liquid/liquid, plate type heat exchanger comprising:

a stack of plates, each of generally rectangular configuration with four corners and opposed ends with the plates in the stack being generally spaced from one another to define a plurality of side by side liquid flow paths, each in heat exchange relation with the adjacent flow path or flow paths;

alternating ones of said flow paths adapted to receive a first heat exchange liquid, the remaining flow paths adapted to receive a second heat exchange liquid;

first holes and spacers in a first corner of said plates defining an inlet for said first liquid to said alternating ones of said liquid flow paths;

second holes and spacers in a second corner of said plates defining an outlet for said first liquid from said alternating ones of said liquid flow paths;

third holes and spacers in a third corner of said plates defining an inlet for said second liquid to said remaining ones of said liquid flow paths;

fourth holes and spacers in a fourth corner of said plates defining an outlet for said second liquid from said remaining ones of said liquid flow paths;

an entry conduit extending between said inlet for said first liquid and one of said third and fourth holes and spacers and having an inlet port for receipt of said first liquid;

a flow control valve in said entry conduit between said entry port and said inlet for said first liquid for controlling the flow of said first liquid through said alternate ones of said flow paths; and a thermally responsive actuator in said one of said third and fourth holes and spacers to sense the temperature of the second liquid therein, said actuator being mechanically connected to said valve to operate the same.

2. The liquid/liquid, plate type heat exchanger of claim 1 further including a thermally responsive bypass valve connected to said entry conduit.

3. The liquid/liquid, plate type heat exchanger of claim 2 including a bypass conduit in fluid communication with said port and said inlet for said first liquid, said bypass valve being located in said bypass conduit.

4. The liquid/liquid, plate type heat exchanger of claim 1 further including a permanently open bypass conduit extending about said flow control valve.

5. The liquid/liquid, plate type heat exchanger of claim 1 further including a bypass conduit associated with said entry conduit and disposed in bypass relation to said flow control valve.

6. The liquid/liquid, plate type heat exchanger of claim 1 wherein said entry conduit is generally U-shaped and includes a first leg connected to said first liquid inlet and a second leg connected to said one of said third and fourth holes and spacers.

7. The plate-type heat exchanger according to claim 1 wherein:

the heat exchanger further comprises a cover plate and a base plate, the stack of plates being disposed between the cover plate and the base plate such that one of the plurality of plates abuts the cover plate and another of the plurality of plates abuts the base plate, the inlets and outlets attached to the base plate to connect the inlets and outlets with the respective channel groups.

8. A liquid/liquid, plate type heat exchanger comprising:

a stack of plates, each of generally rectangular configuration with four corners and opposed ends with the plates in the stack being generally spaced from one an other to define a plurality of side by side liquid flow paths, each in heat exchange relation with the adjacent flow path or flow paths;

alternating ones of said flow paths adapted to receive a first heat exchange liquid, the remaining flow paths adapted to receive a second heat exchange liquid;

a first manifold defining an inlet for said first liquid to said alternating ones of said flow paths;

a second manifold spaced from said first manifold and defining an outlet for said first liquid from said alternating ones of said flow paths;

a third manifold spaced said first and second manifolds and defining an inlet for said second liquid to said remaining ones of said flow paths;

a fourth manifold spaced from said first, second and third manifolds and defining an outlet for said second liquid from said remaining ones of said flow paths;

a generally U-shaped entry conduit having an inlet port for said first liquid and a first leg connected to said first manifold and a second leg connected to one of said third and fourth manifolds;

a flow control valve located in said entry conduit between said entry port and said first manifold; and a thermal actuator for said valve disposed in said second leg and one of said third and fourth manifolds, and mechanically connected to said valve.

9. The liquid/liquid, plate type heat exchanger of claim 8 wherein said manifolds are respectively defined by first, second, third and fourth holes and spacers in respective corners of said stacks.

10. A liquid/liquid, plate type heat exchanger of claim 8 wherein said first and second manifolds are located at opposite ends of said stack and said third and fourth manifolds are defined by spaced holes and spacer sets in said stack and two different corners thereof.

* * * * *